US006029326A

United States Patent [19]

Semon

[11] Patent Number: 6,029,326

[45] Date of Patent: Feb. 29, 2000

[54] CASKET CONSTRUCTION

[75] Inventor: Joseph R. Semon, Clarks Summit, Pa.

[73] Assignee: Casket Shells, Incorporated, Eynon, Pa.

[21] Appl. No.: 09/120,061

[22] Filed: Jul. 21, 1998

[51] Int. Cl.[7] ..... A61G 17/00

[52] U.S. Cl. ..... 27/10; 27/6

[58] Field of Search ..... 27/2, 6, 10; 403/205, 403/403

[56] References Cited

U.S. PATENT DOCUMENTS 1,989,962 2/1935 Zinser et al. .

2,056,419 10/1936 Cohen .

2,830,354 4/1958 Slaughter ..... 27/10 X 3,531,837 10/1970 Cherry ..... 27/10

4,195,394 4/1980 Semon ..... 27/10

4,304,031 12/1981 Semon et al. ..... 27/10

*Primary Examiner*—Terry Lee Melius

*Assistant Examiner*—William L. Miller

*Attorney, Agent, or Firm*—Kane, Dalsimer, Sullivan and Levy, LLP

[57] ABSTRACT

A metal casket is provided with stabilizing braces at each corner secured to neighboring surfaces of a side panel, end panel and bottom panel to assure and maintain the integrity of the squareness of the casket body, and, consequently, the alignment of the casket lid with the casket body.

4 Claims, 1 Drawing Sheet

CASKET CONSTRUCTION

BACKGROUND OF THE INVENTION

Metal caskets are expensive because manufacturing and assembling the parts is labor intensive and requires many manipulative steps to finish and trim the assembled unit to meet consumer satisfaction and acceptance. Normally, steel, bronze or copper sheet material is utilized and the casket sides, ends, bottom and lid are stamped from such sheet material and then pressed into the desired configuration. The sides, ends and bottom are welded together and the lid hinged and latched to the sides. The welds and joints are subjected to a grinding and polishing operation to enhance casket appearance and then the sides, ends and lid are spray painted. The interior of the thusly formed shell is trimmed in one of many styles. The casket exterior is provided with hardware to complete the outward appearance.

As a result of the many manufacturing and assembling operations, the sides, ends and bottom may shift or flex relative to one another in varying degrees. When this occurs the body and lid alignment suffers and such misalignment renders it extremely difficult to satisfactorily close the casket. If a gasket is interposed between the body and lid the casket seal may be seriously jeopardized.

SUMMARY OF THE INVENTION

It is a principal object of the present invention to improve the body and lid alignment of a casket and, if selected, the gasketed seal therebetween.

Another object is to provide a novel corner brace that assures the proper connection and relationship between the casket sides, ends and bottom to thereby assure proper body and lid alignment.

Other objects and advantages will become apparent from the following detailed description which is to be taken in conjunction with the accompanying drawings.

DETAILED DESCRIPTION

Figure 1:
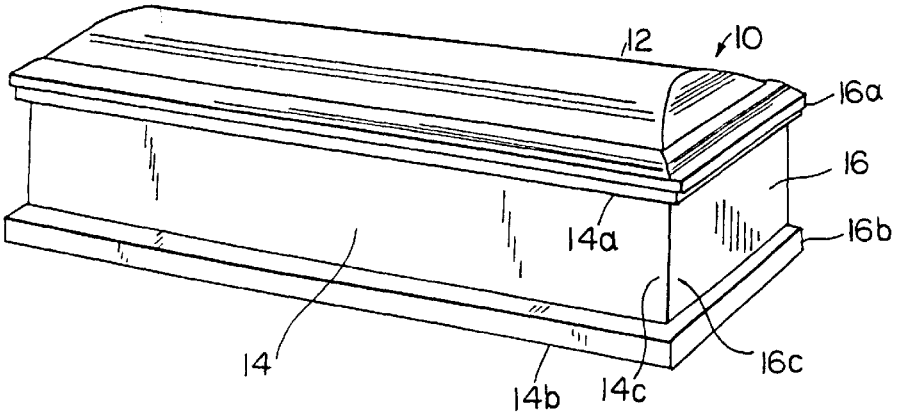
FIG. 1 is a perspective view of a metal casket incorporating the teachings of the present invention, but not including any decorative or traditional hardware.
Figure 2:
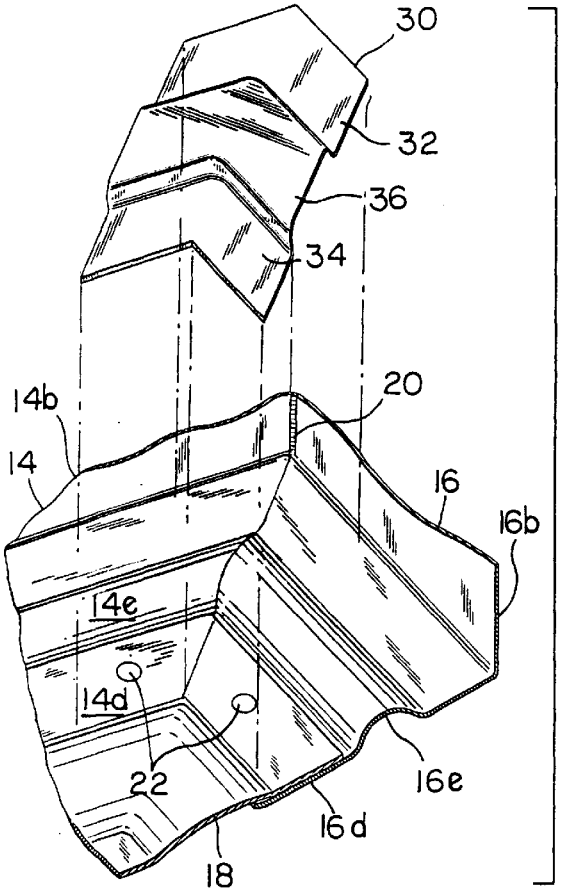
FIG. 2 is an enlarged fragmentary view of a corner of the casket showing a side and end panel welded together and welded to a bottom panel with a corner arrow stabilizing brace prior to being secured in place.

In the drawings, a casket 10 of selected metal, such as bronze, copper or the various grades of steel or zinc coated steel is shown without conventional, decorative, functional or traditional hardware. The casket 10 may be of any one of many different styles and variety including the full and half couch designs. Towards this end, a typical casket will include a hinged cap or lid 12, opposed side panels 14 and end panels 16, as well as a base or bottom panel 18.

In the normal course of securing and squaring the casket, a number of tack or spot welds or continuous weld 20 is applied to the top rail 14*a*, 16*a* and bottom rails 14*b*, 16*b* and intermediate sections 14*c*, 16*c* of the side panels 14 and end panels 16, respectively. In addition, the bottom panel 18 is continuously or tack welded at 22 to the inner faces of lateral base flanges 14*d*, 16*d* of the side panels 14 and end panels, 16 respectively.

In order to assure and maintain the integrity of the squareness of the casket body, and, consequently, the alignment of the lid with the body, the present invention utilizes and applies an arrow stabilizing brace 30 at each corner of the casket. In this connection, each corner arrow stabilizing brace 30 will include a relatively flat front pointed end 32 and a relatively flat rear wing end 34 and a raised intermediate section 36.

Figure 3:
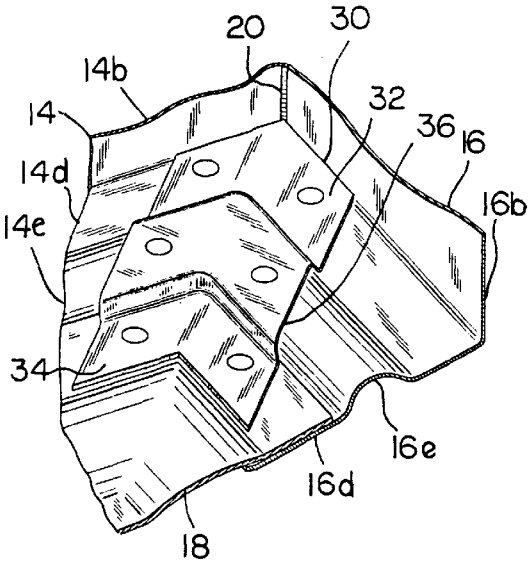
FIG. 3 is a plan view of the casket corner showing the corner arrow stabilizing brace tack welded to the neighboring side and end panels and the bottom panel.

Referring now to FIG. 3, it will be observed that the corner arrow stabilizing brace 30 straddles the joint defined by the beveled ends of lateral base flanges 14*d*, 16*d* of the side panels 14 and end panels 16, respectively, with raised intermediate section 36 received the raised strengthening ribs 14*e*, 16*e*. The relatively flat front pointed end is spot welded to each of the lateral base flanges 14*d*, 16*d* as shown in FIG. 3; and the relatively flat rear wing end 34 is spot welded to the bottom panel 18 as shown in FIG. 3. In order to further enhance the securement of this corner joint, the raised intermediate section 36 may be spot welded to each of the raised strengthening ribs 14*e*, 16*e* as shown in FIG. 3.

Thus, the several aforenoted objects and advantages are most effectively attained. Although a single somewhat preferred embodiment has been disclosed and described in detail herein, it is to be understood that this invention is in no sense limited thereby and its scope is to be determined by that of the appended claims.

I claim:

1. An improved metal casket having a top and bottom and comprising in combination:

a pair of spaced side panels each having opposed ends;

a pair of spaced end panels each having opposed ends, the panels being so constructed and arranged that an end of a side panel is proximate an end of an end panel and such proximate ends being connected by welding to define four corners extending from the top to the bottom of the casket, each side panel and end panel having lateral base flanges at the bottom, and the flange of a side panel and the flange of an end panel having proximal beveled ends at each corner, the panels defining a casket interior;

a bottom panel resting on and secured to the flanges of the side and end panels, the side end and bottom panels constituting a casket body; a lid extending over the top of the casket; a stabilizing corner brace at each corner resting on and directly secured to a side panel flange and an end panel flange adjacent to and straddling each of the proximal beveled ends, the brace resting on and being directly secured to the bottom panel adjacent to each of the proximal beveled ends and being disposed in the casket interior, whereby the stabilizing brace is so constructed and arranged to assure and maintain the integrity of the squareness of the casket body, and consequently, the alignment of the lid with the body.

2. The improved metal casket in accordance with claim 1 wherein each corner brace is arrow-shaped and has a relatively flat front pointed end and a relatively flat rear wing end, the pointed end being spot welded to a side panel flange and an end panel flange adjacent to a proximal beveled end, and the wing end being spot welded to the bottom panel adjacent to this proximal beveled end.

3. The improved metal casket in accordance with claim 2 wherein each corner brace has a raised intermediate section and each flange has a raised strengthening rib straddled by the intermediate section adjacent to the proximal beveled end.

4. The improved metal casket in accordance with claim 3 wherein the intermediate section of each brace being spot welded to the raised strengthening rib of the side panel and end panel of each corner.

* * * * *